United States Patent [19]

Marson

[11] Patent Number: 4,771,306

[45] Date of Patent: Sep. 13, 1988

[54] MACHINE FOR THE TREATMENT OF PHOTOGRAPHIC FILMS

[75] Inventor: Roberto Marson, Pordenone, Italy

[73] Assignee: Gretag San Marco S.p.A., Fiume Veneto, Italy

[21] Appl. No.: 27,822

[22] Filed: Mar. 19, 1987

[30] Foreign Application Priority Data

Mar. 24, 1986 [IT] Italy ..... 45713 A/86

[51] Int. Cl.[4] ..... G03D 3/02; G03D 3/08

[52] U.S. Cl. ..... 354/316; 354/322; 354/329

[58] Field of Search ..... 354/316, 329, 330, 320, 354/321, 322

[56] References Cited

U.S. PATENT DOCUMENTS

| | | | |
|---|---|---|---|
| 4,112,452 | 9/1978 | Patton | 354/330 |
| 4,178,091 | 12/1979 | Solomon | 354/330 |
| 4,252,430 | 2/1981 | Michal | 354/322 |
| 4,456,355 | 6/1984 | Kaufmann et al. | 354/330 |
| 4,502,772 | 3/1985 | Mihara | 354/330 |
| 4,575,209 | 3/1986 | Zwettler | 354/330 |
| 4,655,575 | 4/1987 | Murakami | 354/330 |

FOREIGN PATENT DOCUMENTS

| | | |
|---|---|---|
| 3233531 | 3/1984 | Fed. Rep. of Germany . |
| 2526967 | 11/1983 | France . |
| 59-37542 | 3/1984 | Japan . |

*Primary Examiner*—A. A. Mathews

*Attorney, Agent, or Firm*—Wenderoth, Lind & Ponack

[57] ABSTRACT

A machine for treating photosensitive material in the form of disc films including an enclosure having a series of treating tanks for conducting treatments of disc films, a rotatable support for holding at least one disc film and a support rotatably supporting the rotatable support. A mechanism is provided for moving the support and for placing a disc film held on the rotatable support into solutions contained in the treating tanks. The disc film held on the rotatable support SR is rotated when placed in the treating solutions contained in the treating tanks by the action of a fluid jet against blades on the rotatable support. A first member supported in the enclosure is movable up and down in a vertical direction to respectively remove a disc film from and place a disc film in one of the treating tanks. A groove in the first member slidably engages the support so that the support can move in a longitudinal direction with respect to the first member. A second member supported in the enclosure for movement back and forth in the longitudinal direction has tongues thereon for engaging the support and for moving the support in the longitudinal direction during movement of the second member in the longitudinal direction when the first member is raised and held stationary with respect to the second member. The machine for treating disc films is also combined with a machine for treating roll films such that the same treating tanks are used for treating both types of films.

25 Claims, 5 Drawing Sheets

MACHINE FOR THE TREATMENT OF PHOTOGRAPHIC FILMS

BACKGROUND OF THE INVENTION

1. Field of the Invention

The present invention relates to a machine for the treatment of photographic films which includes a part for the treatment of conventional roll films which have been in use for a long time, which is adequately arranged for use with a new appliance for the treatment of the more recently developed films having a circular disc form, which are commonly called "disc films" and which have not yet been widely used.

This new appliance performs a normal series of treatments on the disc films, which comprise the developing, bleaching, fixing and stabilization, among which adequate washing cycles are interposed, and which terminate with the drying of the photosensitive material. Besides, according to the present invention this new appliance is particularly suitable and expressly conceived so as to be directly and optionally applied on a conventional appliance for the treatment of films having generic uses such as the 35 mm films and the like, in order to obtain considerable commercial and economic advantages.

2. Description of the Prior Art

Appliances are already known for the treatment of disc film, such as those which are described in U.S. Pat. Nos. 4,112,452; 4,178,091; and 4,252,430 and others, which appliances substantially perform the same succession of treatment stages which normally is performed for the treatment of the conventional films. Clearly, it isn't convenient to have available specific appliances for the treatment of disc films only, which as mentioned above are utilized in a relatively limited manner compared to the more conventional films. Accordingly, additional solutions, such as that described in U.S. Pat. No. 4,502,772 have been proposed, in which an appliance for the disc film treatment may operate independently of but also be eventually interconnected to a conventional appliance for the treatment of commonly utilized films.

According to such a solution, the two appliances are completely independent and in practice comprise a conventional appliance for the treatment of the commonly utilized films and a specific appliance for the treatment of the disc films only, the two appliances being reciprocally placed side by side and interconnected in an adequate manner, so that the treatment liquids of the first appliance will be utilized for the second appliance also.

Such a solution, while permitting the obtainment of a practical utilization of the so resulting unit, still does not attain the aim of minimizing the size and the number of components thereof as well as the relevant manufacturing and assembling costs.

SUMMARY OF THE INVENTION

Therefore, it is an object of the invention to provide an appliance, which can simultaneously perform treatments of conventional and disc films, with overall dimensions and components thereof which are minimized, thereby permitting a more economical appliance to be obtained.

The above object is obtained by means of the machine according to the present invention wherein a normal machine is used for the treatment of conventional films, which machine is arranged for the eventual application of a kinematic operated unit for the transport of disc films therein.

Such a machine is characterized in that the tanks containing the chemical baths for the different stages of chemical treatment only are shaped with a limited lateral extent in their upper part, which extent is able to receive support elements for the transport of groups of disc films. Furthermore, a mechanism may be applied on the lateral extent, if required, which mechanism is able to transport at least one of the support elements for the transport of a group of disc films, from a specific loading box towards a collecting container. The groups of disc films are adequately assembled on rotating supports which permit the rotational movement of the discs, required during the different treatment stages, to be obtained directly from the already existing movement of the liquid contained within the different treatment tanks and, during the dripping stage, from a suitable air jet. The final drying is performed in a suitable container, in which a part of the same hot air which is utilized in the main machine for the developing of conventional films is introduced therein.

BRIEF DESCRIPTION OF THE DRAWINGS

In order to understand in a better manner the features and the advantages of the machine of the present invention, the same will be hereinafter described in detail, in a preferred embodiment thereof by way of a non-limiting example only and with reference to the enclosed drawings, in which.

DETAILED DESCRIPTION OF THE PREFERRED EMBODIMENTS

Figure 1:
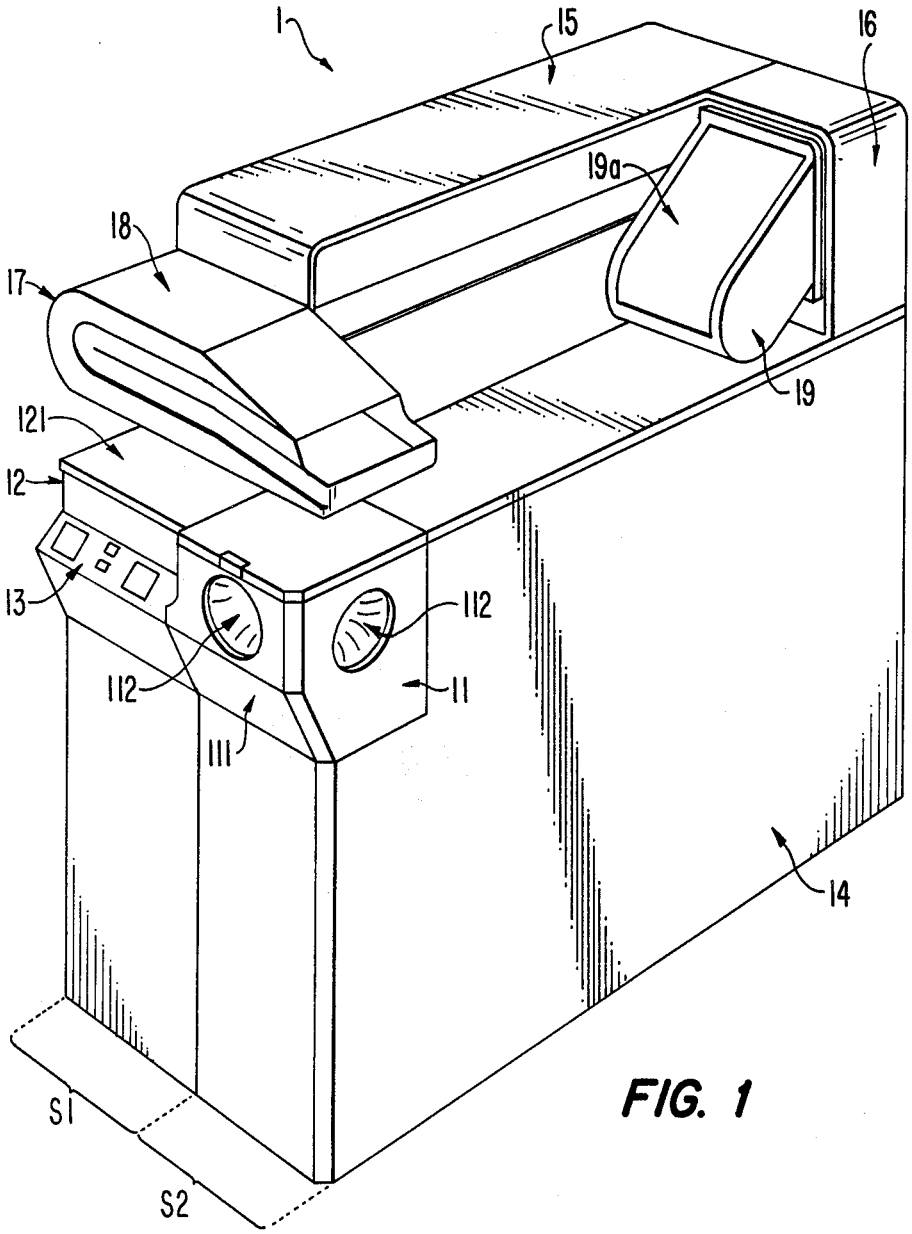
FIG. 1 shows a perspective view of the outer structural configuration of the machine according to the present invention.

Referring particularly to FIG. 1, it is initially pointed out that the main structure of the machine 1 comprises an outer structure constituted by an enclosure forming in its inner side of a light-blocking or light-proof part, in which the appliances for the treatment of the photosensitive material are disposed.

In addition, by examining the machine 1 from its front side (which is illustrated at the left part of FIG. 1 it is to be noted that it comprises a portion S1 (at the left side) and a portion S2 (at the right side) which are placed side by side to each other, wherein the portions S1 and S2 respectively permit the treatment of conventional roll and disc films to be performed Still examining FIG. 1, it is to be noted that such a structure is then subdivided into several parts and more precisely in the front side of the machine at the upper front right corner thereof there is disposed a box 11, adequately raised with respect to the ground, which box acts as the starting point for magazines used for the disc films under lightless conditions, and which box comprises a light-proof front door 111 and also light-proof hoses or loading sleeves 112. A box 12 at a left side of the structure and placed side by side to the box 11 is used for loading the conventional roll films into the respective treatment portion S1.

In turn, the box 12 is provided with a light-proof cover 121 at the upper side thereof and additionally a control panel 13 is directly disposed below the loading box 12. A further box 14 extends rearwardly from the front side of the machine, within which are contained the appliance for the chemical treatments of the conventional films and that for the chemical treatment of the disc films.

A box 15 used for the drying operation of the portion S1 is situated upon the box 14, at the left side thereof, the box 15 projecting at its rear end portion toward a drying box 16 of the portion S2, thereby forming an "L"-shaped structure as shown.

Moreover, at the front side of the box 15 there is disposed a box 17 acting as an outlet side of the material which has been treated within the portion S1, wherein the box 17 comprises an angular module 18 for returning the treated material, which is able to convey the same material to its right end portion from which the material may be removed and collected in a suitable manner.

At the front side of the box 16 there is provided a box-like container 19, which is able to receive a suitable number of support elements S-SR for the transport of the disc films D at the outlet of the box 16 and at the end of the treatment which has been performed by the respective portion S2 thereof.

The box-like container 19 is provided with a adequate door **19*a* in its upper side, in order to permit the operator to extract therefrom the support elements for the transport of the disc films, which are stored therein during the operation of the machine. Therefore, as the general configuration of the machine has been completely described, now the inner part of the machine which is clearly illustrated as a whole in FIGS. 2, 3 and 4** will be described.

From such figures it is initially pointed out that the group of tanks V are used for storing the different liquids which are utilized for the chemical treatment of both the conventional and disc films.

The tanks V are reciprocally disposed side-by-side and longitudinally aligned according to a conventional succession arrangement of the treatment stages, in the following manner: a development tank SV, two bleaching tanks SB, a washing tank L1, two fixing tanks FS, two washing tanks L2, and a stabilization tank ST.

The succession arrangement of two tanks in which the same treatment stage SB, FS, L2 occurs, depends on the specific time required for it to be performed.

It should be noted that each tank is basically constituted by a container comprising a first portion 71, having a substantially parallelepiped shape with a rectangular cross-section and an overhanging second portion 72 at the upper side of the first portion 71. The laterally projecting second portion 72 has a limited height in correspondence of one of the shorter sides of the first portion 71. An inclined bottom wall 73 of the second portion 72 is joined to the first portion 71, thus forming a single basin.

The first portion 71 is reserved for the treatment of the conventional films, which will be carried out in a conventional manner by utilizing known appliances, which are neither illustrated nor described. On the other hand, the second portion 72 is reserved for the treatment of the disc films.

Figure 5:
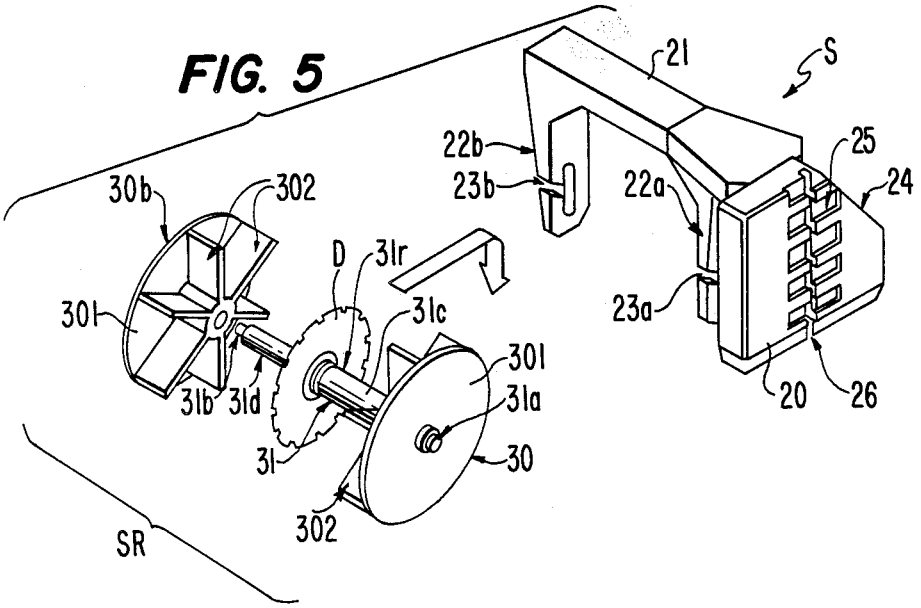
FIG. 5 shows an exploded perspective view of a single support element for the transport of a group of disc films, which is constituted by a rotating support on which the disc films are applied and by a transport element on which the rotating support is applied.
Figure 7:
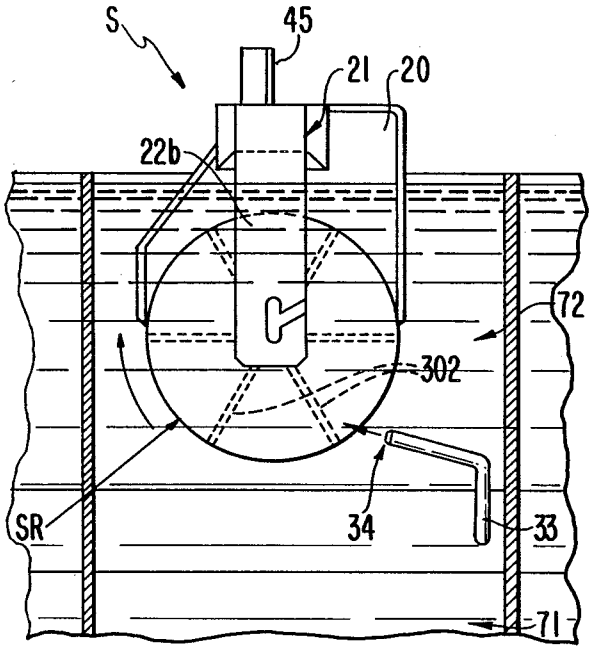
FIG. 7 shows a cross section along the line I—I of FIG. 6 of the support element for the transport of the disc films, which is illustrated in FIGS. 5 and 6, and of the system for the rotating driving of the respective rotating support.
Figure 6:
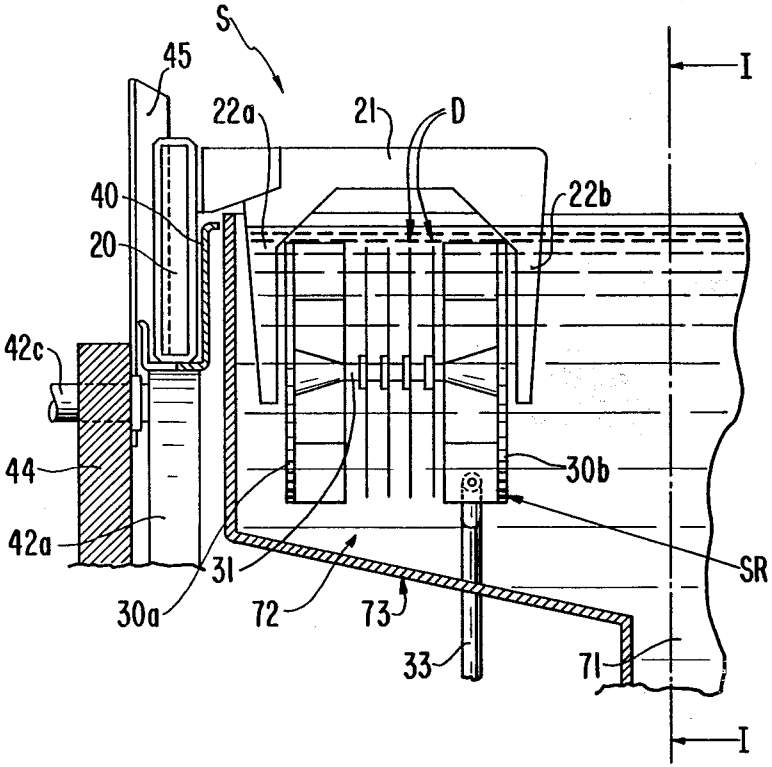
FIG. 6 shows a partial transversal cross section of one of the tanks for chemical treatment and a support element for the transport as illustrated in FIG. 5, which is completely assembled and provided with some disc films supported on it, and which is immersed into the liquid of the bath for the chemical treatment.

On the side of the apparatus constituted by the group of second portions 72 of the tanks there is disposed a transport mechanism TR, in order to shift from one tank to another one adequate support element S on which respective rotating supports SR for the disc films are applied. As can be seen in FIGS. 5, 6 and 7, the support elements S are constituted by a slidable plate 20, from the upper portion of which an arm 21 is orthogonally projecting, which arm is provided near its opposite end portions with two depending spaced-apart plates **22*a* and 22*b*, which are parallel to the slidable plate 20**.

In addition, each plate **22*a*, 22*b* includes an elongated slot or hole 23*a*, 23*b* near its respective free end portion, which slotted holes receive lateral pins 31*a* and 31*b* of the rotating support SR which will be hereinafter described. The pins 31*a*, 31*b* are passed to the slots 23*a*, 23*b* through adequate lateral slits which are downwardly inclined toward the free end portion of each respective plate 22*a*, 22*b*, thereby permitting the rotating support SR to be rotatably supported by the lower end portions of the elongated holes 23*a*, 23*b***.

Obviously, the rotating support SR may also be rotatably supported on the support S in other different manners, equivalent to that which has been described and to which reference is made.

The slidable plate 20 presents a substantially rectangular outline, whose front upper corner 24 (by considering the shifting direction of the support S when it is applied onto the transport device TR) is bevelled in a suitable way for reasons which will be hereinafter described. Moreover, a notched band 25 comprising a series of depressions is provided at a face of the slidable plate 20 which is opposite to that from which the arm 21 extends. The band 25 is located near the middle of the plate 20 and practically in correspondence with the zone in which the arm 21 is extending therefrom, wherein the notched band 25 is extending from the upper to the lower side of the face referred to as well as in a direction which is orthogonal with respect to these sides. Finally, a longitudinal slot 26 is provided through the series of depressions in an axial direction with respect to the length of the notched band 25. Also, the functions of the notched band 25 and the longitudinal slot 26 will be hereinafter described.

The rotating support SR is formed by two bladed discoidal elements 30*a* and 30*b*, identical in shape to each other, each of which is constituted by a disc 301 provided with radial blades 302 on one side thereof and having, for obvious reasons, a diameter which is somewhat greater than that of the disc films D.

On a first discoidal element 30*a* there is fixed a shaft 31 which has a length slightly greater than the distance between the outer faces of the plates 22*a*, 22*b*. The shaft 31 projects from the face of the relative disc 301 which face isn't provided with radial blades 302 and a short end portion of the shaft 31 forms the previously described lateral pin or stud 31*a*. On the other hand, the shaft 31 includes a first portion 31*c* projecting on the opposite side thereof having a suitable diameter, permitting it to be inserted into the central hole of the relative disc films D and a length which is sufficient to permit a good number of such disc films D to be supported on it. A second portion 31*d* of the shaft 31 has a diameter which is somewhat smaller than that of the first portion 31*c*, and is able to removably receive a second discoidal element 30*b*, which is arranged thereon with the bladed portion thereof facing toward the inner side of the support SR, (which portion is opposite to that of the previous discoidal element), wherein the second portion 31*d* has such a length that, after the application of the second discoidal element 30*b*, a short portion thereof is protruding from the non-bladed face of element 30*b* with this short portion constituting the previously described lateral pin or stud 31*b*. In addition, the portion 31*c* is provided with a longitudinal projection 31*r* capable of engaging corresponding slots provided within the central holes of the disc films D so as to prevent the rotation of the same with respect to the shaft 31. Therefore, the utilization of the whole support S is explained as follows.

First, one inserts one or more disc films D on the shaft 31 (in the presently described embodiment it is foreseen that at most six disc films will be supported on the support S), and thereafter the discoidal element 30*b* is fitted on the shaft 31.

The resulting unit (the completely assembled support SR) is applied onto the support S by introducing its lateral studs 31*a* and 31*b* into the relative elongated holes 23*a* and 23*b* provided in the plates 22*a* and 22*b*, in which the studs slide until they are arranged on the bottom side thereof so as to be rotatably supported. The support and transport element S-SR is thus ready for being utilized.

The particular configuration of such a support and transport element S-SR permits remarkable operational advantages to be obtained with respect to the different equivalent systems which are utilized in other devices or machines for the treatment of the disc films. In fact, as is already known, for the treatment of the disc films it is required that the films be rotated as they are immersed into the different treatment baths and thereafter, as they are leaving such baths, the so-called dripping stage, the same must be effected by means of a centrifuging operation and thus, during this stage the films must also be rotated. In the various machines which have been until now utilized for treating the disc films, the required rotational movement is given to the disc films by means of kinematic operated systems, which obviously are complicated. Such systems normally require more moving sources (motors) as well as complicated systems for transmitting the movement, having different moving parts, such as belts, pulleys, gears, bearings, etc. which are operating immersed into the treatment baths, so that these parts must be made by using particular techniques and suitable materials.

The machine according to the present invention offers a solution which avoids all the kinematic operating devices, which are employed for rotating the above specified disc films and this is obtained by utilizing at least one fluid jet, which determines the rotation of the rotating support SR through a suitable arrangement thereof toward the radial blades 302 of the support SR.

As is already known, the liquids contained within the different treatment tanks are moved by means of respective pumps. Similarly, in the machine referred to and clearly illustrated particularly in FIG. 7, in order to obtain the rotation of the support SR and therefore of the disc films which are disposed thereon, it is sufficient to utilize a moving liquid coming from a feeding tube 33, by directing it to act against the radial blades 302 of the rotating supports SR, through an adequate nozzle 34 which is disposed and oriented in a suitable manner. However, instead of using a single fluid jet it is also possible to use a pair of jets, which are acting on both the bladed discs of the rotating support SR.

Figure 2:
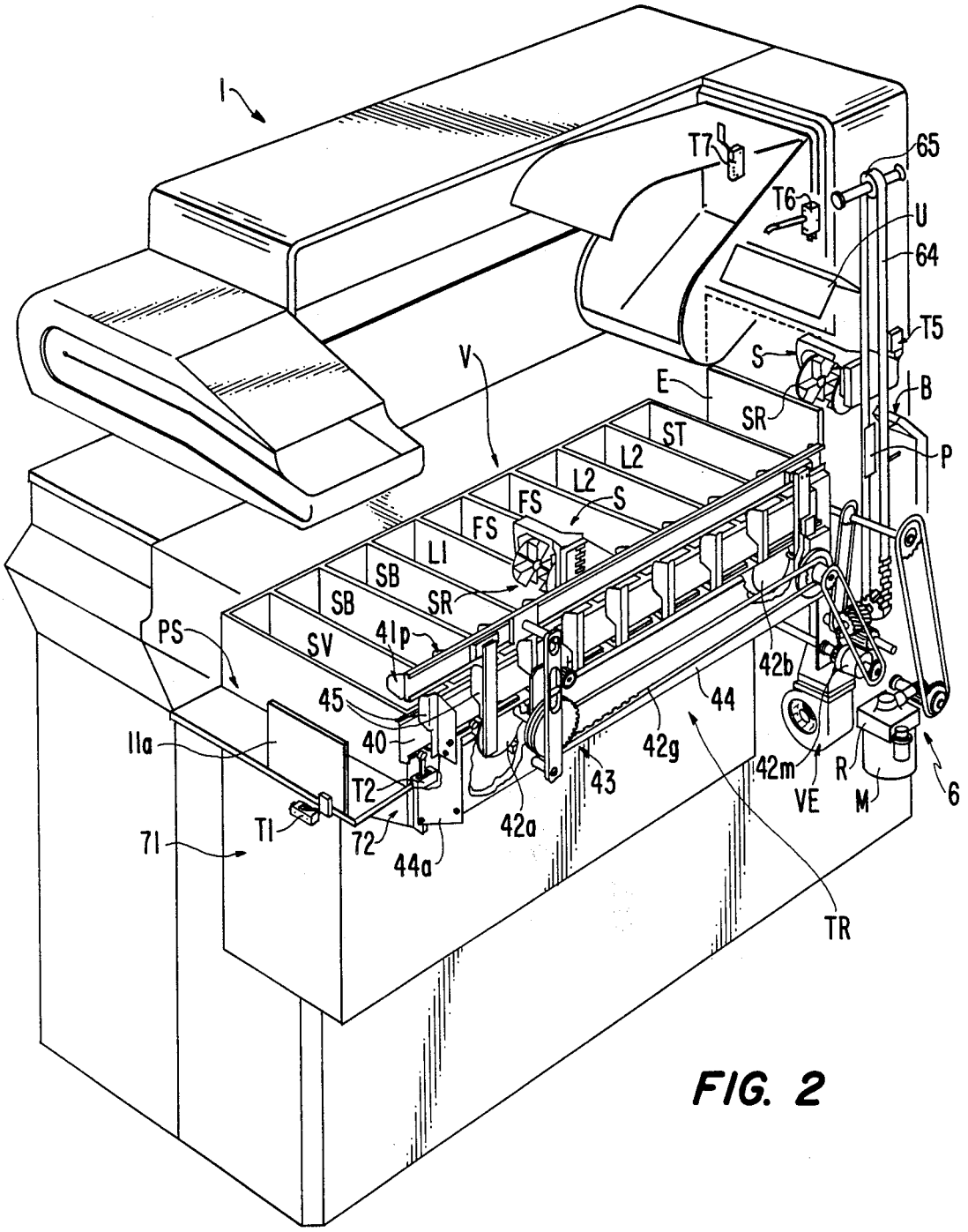
FIG. 2 shows a perspective view, as in FIG. 1, of the same machine whose envelope however is indicated in part only with a thin line, so as to permit illustration of the inner structural items thereof related to the sole part concerning the treatment of the disc films.
Figure 3:
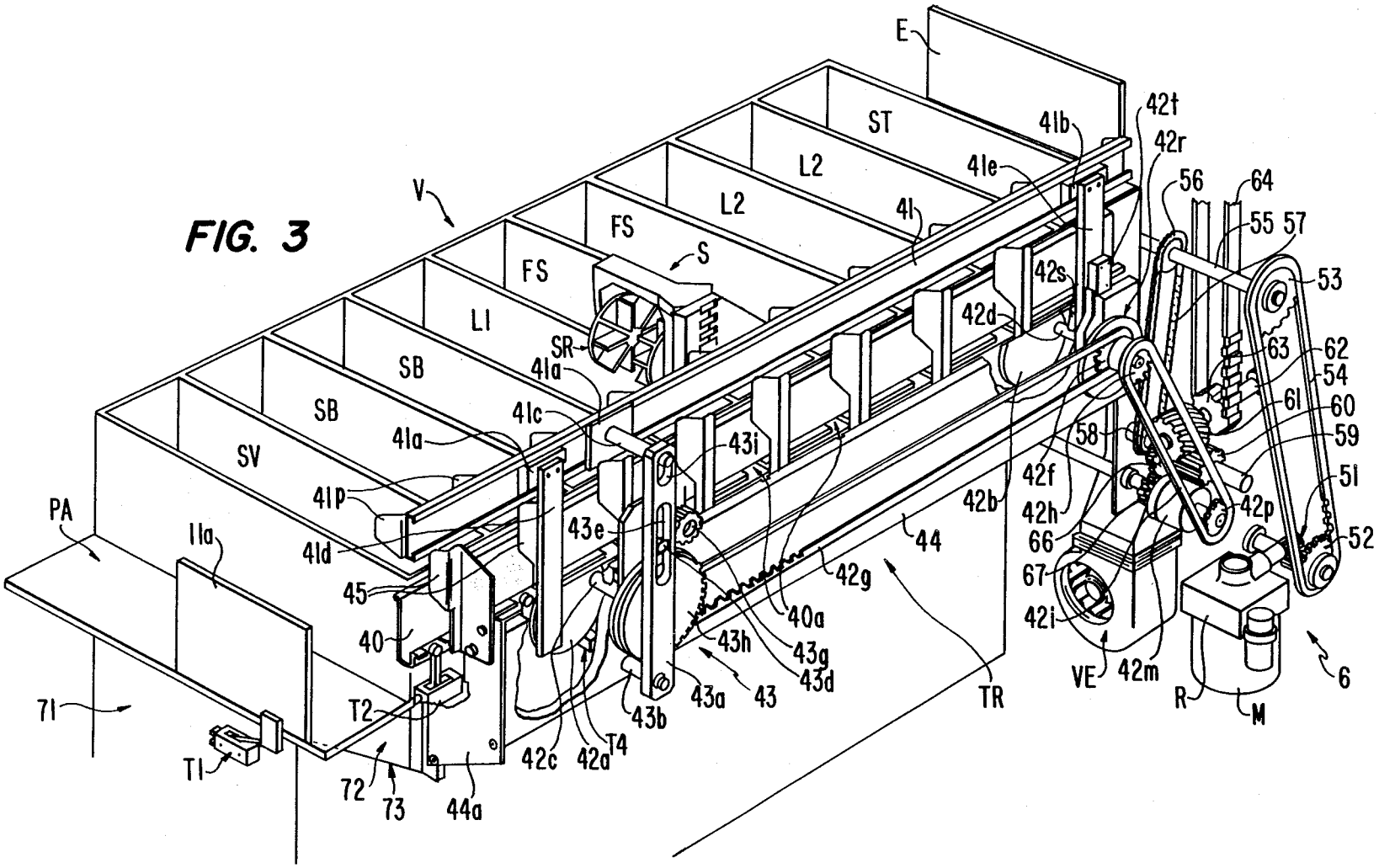
FIG. 3 is a part of FIG. 2, which is adequately enlarged for illustrating the transport mechanism of the disc films and the general driving unit in more detail.

On the other hand, for the "dripping" stage the rotation thereof may be obtained by means of an air jet which is produced by a simple fan VE and oriented in a suitable manner by a relative nosepiece B (see FIGS. 2 and 3). Still considering the machine referred to, the transport of the support and transport elements S-SR through the different treatment tanks V is obtained by means of a new transport mechanism TR, which is hereinafter described.

The transport mechanism TR is constituted by a first vertically movable longitudinal member 40, which is able to slidably support the supports S and which is vertically translatable, by guiding it through adequate vertical guide elements (not shown) and by a second longitudinally movable longitudinal member 41, which is horizontally translatable and guided for movement in a longitudinal direction by sliding blocks 41*a*–41*b*, which are slidably engaged on it and which are fixed on a fixed longitudinal member 44 by means of lateral supports 41*d*–41*e*, which also determine the adequate arrangement of the same member over the first movable longitudinal member 40, wherein the first movable longitudinal member 40 is capable of shifting the supports S from a first lower position, in which they are introduced into a relative treatment tank, to a second upper position in which they are completely extracted therefrom.

In turn, the second longitudinal member 41 is capable of shifting the supports S, when they are in a raised condition at the second upper position, from one tank to over another respective tank.

As is clearly evident from FIGS. 2 and 3 and more specifically from FIG. 6, the first movable longitudinal member 40 has a structure with an asymmetric "U"-shaped cross-section, thus forming a groove at its lower part, in which groove the slidable plate 20 of the supports S may slide, and is provided with some cavities 40*a*, which permit guide plates 45 hereinafter described to pass therealong.

The vertical translation of the first longitudinal member 40 is obtained by means of two cams 42*a* and 42*b*, which are situated near its end portions and on which the longitudinal member 40 is supported, wherein such cams 42a–42b are connected, through respective shafts 42c–42d rotatably supported by the fixed longitudinal member 44, to toothed pulleys 42e (not shown in FIG. 2) and 42f, which are reciprocally interconnected through a toothed belt 42g, so that the movements of the cams 42a–42b are synchronized. It should be noted that an additional cam 42r is coaxially disposed with respect to the cam 42b and is fixed onto the shaft 42d and a free end portion of a flat spring 42s is engaged with the additional cam 42r. The flat spring 42s is fixed at its other end portion to a block 42t, which in turn is fixed to the lateral support 41e.

The function of the additional cam 42r and spring 42s is to obtain a resilient accompanying condition or dampening of the descent movement of the first movable longitudinal member 40, so as to bias the cam in a direction opposite to the direction of rotation thereof and thereby prevent too rapid and uncontrolled falling thereof due to the shape of the cams 42a–42b, and the consequent drawbacks caused thereby.

On the other hand, the horizontal translation of the second longitudinal member 41 is obtained by means of an intermittent crank and slotted link 43. Such an intermittent crank and slotted link 43 is constituted by a rigid rod member 43a, which is pivoted at its lower end portion of the fixed longitudinal member 44 by means of a pin 43b, wherein oscillating movement of the rod 43a is effected by a crank, whose crankpin 43d is engaged within a slot 43e provided at an intermediate portion of the rigid rod 43a and whose crank arm (not visible in FIG. 2) is fixed to a sprocket wheel 43g, which receives intermittent movement from a partial gear wheel 43h, whose toothing is extended for about only ⅓ of its circumference, and which is fixed to the front end portion of the shaft 42c.

Finally, the rigid rod 43a is provided at its upper end portion with a slot 43i, in which a pin 41c fixed onto the second longitudinal member 41 is engaged.

Moreover, on the front end portion of the shaft 42d there is fixed a further pulley 42h, which is connected through a toothed belt 42i to a pulley 42p, which in turn may be driven by the main driving unit 6 by means of an electromagnetic clutch 42m.

In further describing the transport mechanism TR, it is to be noted that the fixed longitudinal member 44 is fixed to the structure of the group of tanks V by means of lateral supports 44a and that the guide plates 45 are fixed onto the longitudinal member 44, the guide plates 45 being spaced equally apart by a distance equal to the width of the single tanks with one guide plate 45 for each tank. The guide plates 45 are located at the level of the transversal axis of each tank and are vertically disposed and orthogonally extended from the inner surface of the fixed longitudinal member 44 as well as partially protruded from the structure of the first longitudinal member 40.

The function of the guide plates 45 is to guide the vertical translation of the supports S, which is effected by the first longitudinal member 40, which in turn is provided, as already described, with respective cavities 40a in correspondence with each guide plate 45, permitting it to pass therealong during its movements.

Moreover, also onto the second longitudinal member 41 are fixed tongues 41p which are also vertically disposed and orthogonally extended as well as turned toward the inner side therefrom, which tongues are reciprocally equally spaced in the same manner as the guide plates 45. The function of the tongues 41p is to effect the shifting of the supports S from one tank to another tank.

Finally, it is to be noted that in the machine referred to only the main driving unit 6 is provided, which drives, as is described in detail hereinafter, all the different kinematic operating devices of both the portions S1 and S2.

The main driving unit 6 comprises a single motor M which, in its driven condition, by means of an adequate transmission system, reduction gear R, a pair of helical gears 51, a pair of toothed pulleys 52–53 interconnected by a toothed belt 54, rotatably drives a main shaft 55 which in turn is connected to the treatment apparatus of the portion S1, thereby directly operating the same. In addition, a gear wheel 56 is assembled onto the main shaft 55 and is connected by a chain 57 to a gear wheel 58, which is fixed onto a shaft 59, onto which a helical gear 60 engaged with a helical gear 61 is also fixed, wherein the helical gear 61 is fixed onto a shaft 62, onto which a toothed pulley 63 is also fixed.

Therefore, it follows that in the operating condition of the apparatus of the portion S1, the toothed pulley 63 is also rotatably driven thus driving the toothed belt 64, interposed between a toothed pulley 63 and a toothed pulley 65 which is situated in the upper part of the box 16.

As it will be hereinafter described, the toothed belt 64 is used for translating upwardly the supports S, contained within the box 16, to which the supports are supplied after the chemical treatments have been effected, and is used for carrying these supports at the outlet zone thereof. Clearly, the toothed belt 64 just described is always driven when the apparatus of the portion S1 is operating. Finally, the shaft 59 is connected by means of the pair of gear wheels 66–67 to the electromagnetic clutch 42m, so that the apparatus of the portion 52, i.e. the above described transport mechanism TR thereof will only be operating when the electromagnetic clutch 42m has been operatively engaged.

At the end portion of the shaft 55 there is provided a suitable connection element (not shown in the figures referred to above), onto which a crank may be applied for permitting, in the case in which the electrical supply is accidentally switched off, manual movement of the kinematic operating devices for shifting the photosensitive material under treatment, so as to avoid the destruction thereof. In addition, between the connection element and the shaft 55 there is disposed a coupling permitting driving in a single direction to be obtained, like an already known free-wheel device, which disconnects for obvious reasons the mechanical connection to the part driven by the geared motor M-R.

In the case in which only the disc films treatment group is applied thereto, there is also provided a buffer battery which is able to feed, in the above mentioned case of switching off the electrical supply, a microprocessor which is provided, as will be hereinafter described, for operating and controlling the cycles and all the other functions of the machine (safety, different signaling, alarm devices, etc.) as well as the electromagnetic clutch 42m.

In this manner, the manually operated emergency control may effect both the kinematic operating devices for the transport of the conventional films under treatment within the portion S1 and those of the transport mechanism TR of the disc films under treatment within the portion S2.

In order to complete the description of the machine, it is to be noted that the box 11 for the initial handling of the magazines of the different film kinds also acts for loading the portion S2, so that it will be provided with a suitable lightproof door 11*a* (see FIG. 4), which permits the supports S-SR together with the relative disc films D to be introduced into the relevant treatment part.

In addition, further lightproof movable diaphragms are also provided, such as a movable diaphragm E which is disposed on the front wall of the box 16, in correspondence with the outlet side of the supports S which are supplied from the chemical treatment part of the machine and another movable diaphragm U which is disposed within the dripping zone situated before the drying zone of the machine, in correspondence with the outlet side of the supports S which are supplied from the dripping zone thereof.

In order to effect an accurate control and co-ordination of the various cycles and different functions of the machine, there is provided a specific microprocessor, which is adequately programmed for processing the different signals utilized with the different command, control, signaling and survey devices as well as positioning devices for different parts, etc. Among such devices, hereinafter described are at least some micro-switches (or similar survey devices), which are clearly illustrated in FIGS. 2, 3 and 4 and which are required in order to have a clear explanation of the description of the operation of the machine, as will be subsequently described.

A first micro-switch T1 is situated in correspondence with the door 11*a* and is effective for giving a suitable acoustic and/or luminous signaling when the door 11*a* is open.

A second micro-switch Tw is situated in correspondence with the first cavity 40*a* of the longitudinal member 40, within the so-called "waiting place" PA, and it is effective for giving a luminous and/or acoustic signaling for indicating that a group S-SR for the support and transport of the disc films D has been loaded, as well being effective for permitting the starting of the transport cycles until the group S-SR is introduced into the dripping room.

A third micro-switch T3 is situated in correspondence with the second cavity 40*a* of the longitudinal member 40 and therefore with the first tank SV. This micro-switch is effective for switching off the signaling which has been produced by the intervention of the former micro-switch T2, controls the increment of the regeneration developing acid into the tanks SV, in order to compensate for any increased need for such acid due to the presence of the additional disc films, and also changes the stopping time provided for the operating cycles by adjusting the same to the required treatment of these films.

A fourth micro-switch T4 is actuated by the cam 42*a* when the latter has completed an entire rotation. This switch switches off the electromagnetic clutch and is effective for providing an alarm by acoustic and/or optic signaling, in the case in which a starting failure of the transport operation occurs.

A fifth micro-switch T5 is situated in the lower part of the box 16 and is actuated by the presence of a support group S-SR, which enters into the dripping zone of the machine directly after having left the chemical treatment zone thereof. This switch operates the fan VE for a time period which is determined by the microprocessor and, after a further time period determined by the microprocessor, it releases an alarm signal for signaling that the group S-SR hasn't been evacuated.

A sixth micro-switch T6 is situated in the upper end portion of the drying box 16 and is positioned in such a manner therein that it may survey the presence of a support group S-SR as the latter is being uncoupled from the ascending toothed belt 64, and after a time period which is always determined by the microprocessor it releases a recall signal to inform the operator of such a presence.

Finally, a seventh micro-switch T7 is situated at the initial zone of the box-like container 19, in order to send an alarm signal when the container is completely filled.

A concise description of the machine operation will now be given as follows.

Initially, the operator effects the normal handling, if required, of the conventional films within the box 11 and then their loading into the respective portion S1.

On the other hand, the operator introduces the disc films into the box 11, through the door 111, the relative magazines thereof together with at least one of the above described supports S and the relative rotating supports SR, the operator opens the magazines by operating through the hoses 112 and inserts a convenient number of disc films D onto the shafts 31 of the rotating supports SR. After that, the operator completes each single rotating support SR with the relevant discoidal element 30*b*, then applies it onto the corresponding support S and the so completed unit is prepared for being loaded into the portion S2. Then, the operator opens the door 11*a* and applies the unit S-SR-D onto the first longitudinal member 40 by introducing the plate 20 of the relative support S thereof into the first cavity 40*a* provided in the first longitudinal member 40, by arranging it therein in such a manner that at the same time the first guide plate 45 penetrates into the longitudinal slot 26 of the same plate 20. Thus, the support S is disposed in the so-called "waiting place" PA at the beginning of the treatment apparatus and is ready for the beginning of the operating cycle.

Then, the operator closes the door 11*a* by switching off the signaling of the relevant micro-switch T1 and, as soon as the operator surveys the control panel to determine that all is in order, since the micro-switch T2 of the waiting place signals that the loading has been effected, and starts the operation of the apparatus of the portion S2. The starting control operates the electromagnetic clutch 42*m* (and also the motor M, if the same isn't operating) which connects the apparatus of the transport mechanism TR to the main driving unit 6, so that the cams 42*a*–42*b* start to rotate, by shifting the first movable longitudinal member 40 upwardly and therefore also the support S which has been loaded at the initial part thereof.

When the first longitudinal member 40 is disposed upwardly, the plate 20 of the support S is disengaged from the plate 45 and inserted between two tongues 41*p* of the second movable longitudinal member 41.

At the same time, the partial gear wheel 43*h* also rotates and as soon as the cams 42*a*–42*b* have sufficiently shifted the first movable longitudinal member 40 upwardly, the toothed portion of the partial gear wheel 43*h* begins to engage the sprocket wheel 43*g*, thereby causing the sprocket wheel 43*g* to be rotated.

As a consequence thereof, the crank which is connected to the sprocket wheel 43*g* causes the rigid rod 43*a* to be oscillated, which rod in turn operates the second movable longitudinal member 41, during the first oscillation stage, in such a manner as to shift it forward with respect to the direction in which the treatment is carried out, by a length which is equal to the width of a single tank.

It follows that the support and transport unit S-SR, which is raised and no longer has its longitudinal slot 26 engaged with the first guide plate 45, but rather is inserted between the two first tongues 41*p* of the second longitudinal member 41, is pushed by the first of these two tongues 41*p* which is bearing against the rear side of its slidable plate 20, so that the unit is shifted from the waiting area to a position situated over the first tank SV, in correspondence with the center thereof.

By continuing in their rotational movement, the cams 42*a*–42*b* move the first longitudinal member 40 downwardly, so that the support unit S-SR descends and penetrates into the first tank SV, by disengaging it from the tongues 41*p* and at the same time engaging it with the second guide plate 45, which penetrates in its longitudinal slot 26, thereby ensuring the correct arrangement thereof at the center of the tank SV.

As soon as the support S has been disengaged from the tongues 41*p*, the rigid rod 43*a* begins moving in a second oscillation stage (in a direction which is opposite to the first one), thus operating the second movable longitudinal member 41 to return to its starting position, and at the same time the flat spring 42*s* engages itself with a protruded part of the cam 42*r*, so that the remaining down stroke of the longitudinal member 40 is controlled and resiliently dampened, thus avoiding in this manner an effective dropping movement due to the outline of the cams 42*a*–42*b* and therefore the relevant drawbacks thereof.

At the end of the cycle, the toothed portion of the partial gear wheel 43*h* disengages itself from the sprocket wheel 43*g* and at the same time the cam 42*a* (see FIG. 4) actuates the micro-switch T4 which, by means of the microprocessor, switches off the electromagnetic clutch 42*m* thus stopping in this manner the cycle for a time period required by the relative treatment stage and by releasing, in the case of a starting failure of the transport, a suitable alarm signal. Simultaneously, the support S actuates the micro-switch T3, at the end of its down stroke, which micro-switch switches off the signaling "occupied waiting place", always by means of the microprocessor, as well as causes a suitable increment of developing acid to be introduced into the relevant tank SV, so as to compensate for the greater requirement thereof due to the additional disc films and it also changes the stopping time period of the cycles, to adjust the same to the treatment required for the disc films.

Therefore, the kinematic operated unit of the transport mechanism TR is ready for repeating another cycle. Hence, a succession of cycles will be carried out, which cycles permit the transport of the support unit S-SR through the series of tanks for the chemical treatments to be effected, wherein the rotating supports S contained within these tanks are rotated, as already described, together with the relative disc films D which have been applied on the same, by means of the effect of the liquid which is oriented against the respective bladed discoidal elements 30*a*–30*b* and is passing though the nozzles 34, during the stopping period which are provided at the end of each cycle.

When the support unit S-SR reaches the last tank ST, at the end of the relevant stabilization cycle thereof, the movable diaphragm E is opened so that the support unit S-SR is introduced, due to the effect of the transport mechanism TR, into the dripping zone provided within the box 16 and arranged in a manner in which the notched band 25 provided in its plate 20 is disposed side-by-side with respect to the toothed belt 64 and at the same time it actuates the micro-switch T5. At this point, the movable diaphragm E is moved to its closed position and the fan VE is also operated, for an appropriate time period, by means of the micro-switch T5 and always under the control of the microprocessor.

In this manner, the fan VE generates an air jet which is oriented by the nosepiece B against the radial blades 302 of the rotating support SR, thereby causing the latter to be rotated. Thus, the dripping of the disc films D arranged thereon is obtained by means of centrifuging these films.

Then, a sliding block P is operated in such a manner as to push the upwardly moving portion of the toothed belt 6 against the plate 20 of the support S. Thus, the toothed portions of the toothed belt 64 are engaged with the corresponding toothed portions of the notched band 25 provided on the plate 20, and consequently the support unit S-SR is moved upwardly, while at the same time being guided by means of guide elements (not shown), in which the plate 20 is engaged.

Then the support unit S-SR passes through the diaphragm U and automatically opens it, thereby entering into the upper zone of the box 16 in which circulates the same hot air as in the drying zone of the treatment portion S1, which air is drawn from such a drying zone and blown into the drying zone of the treatment portion S2 of the disc films D, by means of the fan (not shown) which is placed on the wall which divides the two drying zones. In this manner, during the transit within such an upper zone the disc films D arranged on the support S are dried.

The movable diaphragms E and U are synchronized with each other, in such a manner that when one diaphragm is open, the other one is definitely closed.

In particular, the movable diaphragm E is always operated so as to be in an opened position by the cam 42*b* at the end of each operating cycle and remains open for the entire stopping time period of the cycle.

The unit S-SR passes through the diaphragm U only when the movable diaphragm E is closed, at an operating sequence which is normally predetermined. The support unit S-SR continues along its travel path until it comes in correspondence with the upper end portion of the toothed belt 64 (pulley 65), where it automatically disengages itself from the latter while remaining practically in a stationary position, and in this position it actuates the micro-switch T6 which, after an appropriate time period always determined by the microprocessor, permits, a suitable acoustic (and/or luminous) signal to be released, in order to inform the operator that this unit must be removed.

When a second support unit S-SR arrives, the previous unit S-SR which is still as described is ultimately pushed upwardly and during such a displacement the beveled front upper corner 34 of its plate 20 bears against a suitable inclined plane (not shown), which causes the same to be shifted toward the front part of the machine, so that it passes along the box-like container 19 in which it is stored.

Figure 4:
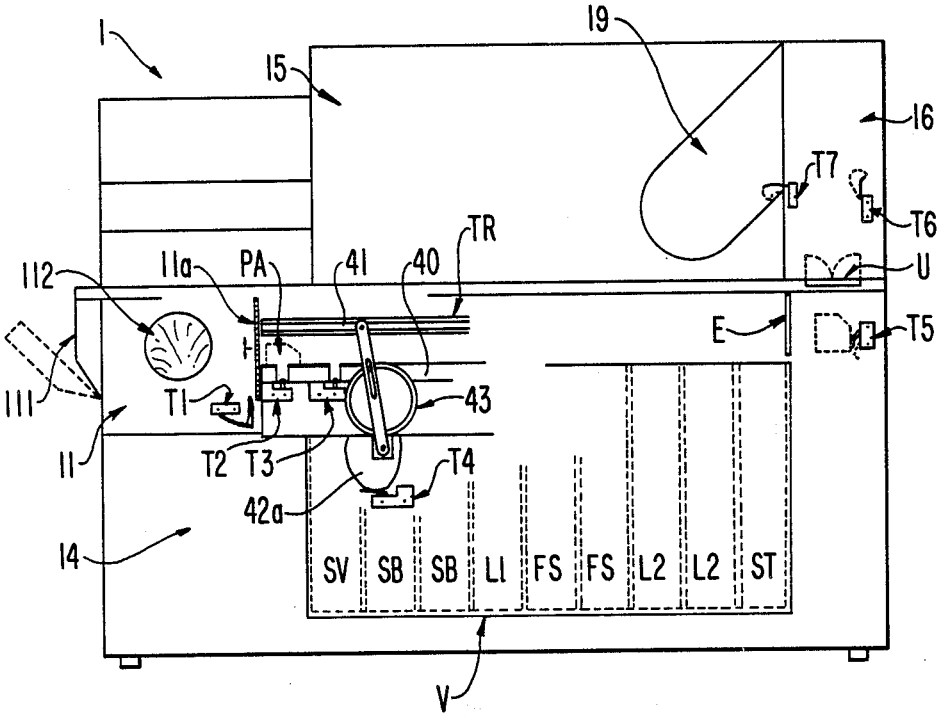
FIG. 4 is a side view taken from the treatment side of the disc film, which schematically illustrates the moving path of the latter from the loading to the unloading side, together with a part of the transport mechanism thereof as well as the arrangement of the light-proof movable diaphragms and the survey devices for the positioning of the support elements for the transport of the groups of the disc films.

As it may be seen from FIGS. 2 and 4, at the beginning part of the box-like container 19 the micro-switch T7 is located, whose central lever is shifted during the passage of each single support unit S-SR and returned to its starting position after passage of each unit, and this operation is repeated until the box-like container 19 has been filled (in the machine referred to above, three support units S-SR can be stored in the container 19), wherein the last of the support units S-SR maintains the lever in a deviated position so that after a time period determined by the microprocessor it actuates a suitable acoustic (or possibly a luminous signal also) alarm signal, which informs the operator that the units S-SR stored within the box-like container may be extracted therefrom, by opening the door 19*a*.

Evidently, in addition to the above mentioned different lightproof movable diaphragms, doors, etc., further light intercepting devices may be foreseen, which devices are able to totally prevent light penetration therethrough, particularly in the chemical treatment zone in which the photosensitive material may be altered.

From what it has been described, the advantages which may be obtained by utilizing the machine referred to should be evident. In fact, such a machine fundamentally is constituted by a conventional machine for the treatment of the conventional films, which machine forms the base structure which is so arranged that a unit for the treatment of the disc films may be applied optionally thereon, which unit is simple to use and easily adapted to the conventional machine.

The recirculation of the liquids for the chemical treatments toward the respective tanks is already arranged, in a manner which acts against the rotating supports SR, onto which the disc films D to be treated are disposed, in order to produce the required rotational movement thereof.

It follows that the addition of the treatment part of the disc films D does not require hydraulic pipe connections nor additional pumps. The system which is used for rotating the disc films D is very simple and reliable, so that any complicated mechanical connection among the supports of the disc films D to be rotated and the outer driving sources can be avoided.

Finally, the transport unit TR of the disc films D does not require an autonomous driving source, since it may be simply interconnected to the main driving unit 6 which has been already provided for in the base structure.

It will be understood that while the present invention has been described with reference to the foregoing embodiments, many changes and modifications may be made thereto which fall within the scope of the appended claims.

I claim:

1. A machine for treating photosensitive material in the form of disc films comprising:

an enclosure having a series of treating tanks for conducting treatments of disc films;

a rotatable support having means thereon for holding at least one disc film;

a support rotatably supporting said rotatable support;

means for moving said support and for placing a disc film held on said rotatable support into solutions contained in said treating tanks;

means for rotating the disc film held on said rotatable support when placed in the treating solutions contained in said treating tanks, said rotating means comprising blade means on said rotatable support for causing said rotatable support to rotate about a rotational axis and jet means for directing a stream of fluid aganist said blade means to thereby cause said rotatable support to rotate about said rotational axis;

said means for moving said support comprising a first member supported in said enclosure by means for moving said first member up and down in a vertical direction to respectively remove a disc film from and place a disc film in one of said treating tanks, means on said first member for slidably engaging said support so that said support can move in a longitudinal direction with respect to said first member and a second member supported in said enclosure by means for moving said second member back and forth in said longitudinal direction, said second member having means thereon for engaging said support and for moving said support in said longitudinal direction during movement of said second member in said longitudinal direction when said first member is raised and held stationary with respect to said second member.

2. The machine of claim 1, wherein said support comprises at least one disc having said blade means thereon and said means for holding at least one disc film on said support comprises a shaft extending from at least one side of said disc.

3. The machine of claim 2, wherein said at least one disc comprises a pair of spaced-apart disc which are connected together by said shaft.

4. The machine of claim 1, wherein said support comprises a slidable plate engageable with said first member for movement therealong in said longitudinal direction, said support further including means connected to said plate for rotatably supporting said rotatable support about said rotational axis.

5. The machine of claim 4, wherein said means for rotatably supporting said rotatable support comprises an arm extending from said slidable plate and a pair of spaced-apart plates extending from said arm, said spaced-apart plates each having an opening therein for receiving a respective projection on said rotatable support thereby supporting said rotatable support for rotation about said rotational axis.

6. The machine of claim 5, wherein said openings are elongated in a vertical direction and connected to respective side edges of said spaced-apart plates by slits which are downwardly inclined towards said elongated openings and sized to slidably receive said projections of said rotatable support whereby said rotatable support can be readily attached to said support by sliding said projections along said slits and then to a lower end of said elongated openings.

7. The machine of claim 2, wherien said shaft includes a projection thereon engageable with a cut-out in a disc film mounted on said shaft to prevent rotation of the disc film with respect to said shaft.

8. The machine of claim 1, wherein said enclosure further comprises a drying zone and means for moving said support from an area in which said treating tanks are located to said drying zone.

9. The machine of claim 8, wherein said support comprises a slidable plate engageable with said first member for movement therealong in said longitudinal direction, said support further including means connected to said plate for rotatably supporting said rotatable support about said rotational axis, said means for moving said support to said drying zone comprising an endless toothed belt, means comprising a notched band on said slidable plate for engaging said toothed belt, means for rotating said toothed belt and means for engaging said toothed belt with said notched band.

10. The machine of claim 9, wherein said slidable plate includes a corner which is slanted with respect to said vertical direction and said enclosure includes means for engaging said slanted corner and urging said support in a direction away from said notched belt when said support is pushed upwardly by another support carried upwardly by said notched belt.

11. The machine of claim 1, wherein said means for moving said first member comprises at least one cam rotatably mounted on a fixed member, said cam engaging said first member during rotational movement of said cam to thereby raise and lower said first member in said vertical direction, and means for rotating said cam.

12. The machine of claim 11, further comprising means for dampening movement of the first member during downward movement thereof, said dampening means comprising an additional cam fixedly connected to said cam for rotation therewith and spring means engaged with said additional cam for biasing the additional cam in a direction opposite to the direction of rotation of said cam and said additional cam.

13. The machine of claim 1, wherein said means for moving said second member comprises at least one rigid member having a part thereof pivotally mounted about a pivot axis on a fixed member, said rigid member being connected to said second member at a position along said rigid member which is spaced from said pivot axis, said means for moving said second member further comprising means for pivoting said rigid member back and forth in said longitudinal direction about said pivot axis.

14. The machine of claim 13, wherein said means on said second member for engaging said support comprises a plurality of spaced-apart tongues extending from one side of said second member, said support being engaged between an adjacent pair of said tongues during movement of said support in said longitudinal direction.

15. The machine of claim 1, further comprising means for guiding said support in said vertical direction during movement of said first member in said vertical direction, said guiding means comprising a plurality of spaced-apart vertically extending guide plates and a vertically extending slot in said support which is sized to slidably receive a respective one of said guide plates during a lower part of the movment of said support in said vertical direction.

16. The machine of claim 1, further comprising means for detecting said support at various positions throughout said enclosure and outputting respective signals corersponding to said detected positions of said support, means for processing said signals and for controlling said means for moving said first member and said means for moving said second member based on said signals.

17. The machine of claim 8, further comprising fan means for blowing air against said blade means and said rotatable support to thereby rotate said rotatable support and dry disc films held thereon.

18. The machine of claim 1, further comprising means for treating roll films in said treating tanks, the treating tanks being divided into a first section for treating the roll films and a seocnd section for treating the disc films, the second section projecting laterally from an upper end of the first section such that each of said treating tanks in said second section forms a continuous extension of a respective one of said treating tanks in said first section.

19. The machine of claim 13, wherein said enclosure further comprises a drying zone and means for moving said suppport from an area in which said treating tanks are located to said drying zone, said means for moving said support to said drying zone comprising an endless toothed belt, means comprising a notched band on said slidable plate for engaging said toothed belt, means for rotating said toothed belt and means for engaging said toothed belt with said notched band, said means for moving said first member comprising at least one cam rotatably mounted on a fixed member, said cam engaging said first member during rotational movement of said cam to thereby raise and lower said first member in said vertical direction, and means for rotating said cam, said means for rotating said toothed belt including a motor and first linkage means connecting said motor to said toothed belt for causing rotation of said toothed belt upon rotation of said motor, said means for rotating said cam comprising said motor and second linkage means connecting said motor to said means for rotating said cam for causing rotation of said cam upon rotation of said motor, and said means for pivoting said rigid member comprising said motor and third linkage means connecting said motor to said rigid member for causing pivoting of said rigid member upon rotation of said motor.

20. The machine of claim 19, wherein said second linkage means includes an electormagentic clutch having an output side selectively engageable with an input side thereof and fourth linkage means connecting said input side of said clutch to said motor for causing rotation of aid input side of said clutch upon rotation of said motor, said second linkage means further including a gear mechanically connected between said output side of said clutch and a rotatable cam shaft fixed to said cam for causing rotation of said cam shaft upon rotation of said output side of said clutch;

said third linkage means including an elongated slot in said rigid member, gear teeth around a portion of an outer periphery of said gear, a sprocket wheel engageable with said teeth on said gear to thereby rotate said sprocket wheel during only part of each full rotation of said gear, and crank means engaged with said elongated slot and connected to said sprocket wheel for oscillating said rigid member back and forth by pivoting said rigid member about said pivot axis; and said machine further comprises control means for engaging said output side of said clutch with said input side of said clutch in accordance with a predetermined timing sequence for processing the disc films held on said support in said treating tanks.

21. The machine of claim 7, wherein said rotatable support comprises a pair of spaced-apart discs with a shaft fitted therebetween and said blade means comprises a plurality of radially extending blades on each of said discs.

22. The machine of claim 1, wherein said second member is movable a distance in said longitudinal direction to move said support from a position in correspondence with a first one of said treating tanks to a position in correspondence with a second one of said treating tanks which is adjacent to said first one of said treating tanks,

23. The machine of claim 1, wherein said enclosure includes a loading box for loading disc films, said loading box being separated from said treating tanks by a first means for preventing light from passing therebetween, a drying box separated from said treating tanks by a second means for preventing light from passing therebetween and a container for accumulating processed disc films seprated from said drying box by a third means for preventing light from passing therebetween, said treating tanks being downstream of said loading box with respect to a direction in said machine in which said disc films travel on said support to be processed, said drying box being downstream of said treating tanks and said container being downstream of said drying box.

24. The machine of claim 1, wherein said means on said first member for slidably engaging said support comprises a longitudinally extending groove in said first member which is sized to receive a portion of said support.

25. The machine of claim 15, wherein said first member includes a plurality of spaced-apart cavities therein, each of said cavities being positioned in correspondence with a respective one of said guide plates and providing a space for said respective one of said guide plates to pass during movement of said first member up and down in said vertical direction, said guide plates being brought out of engagement with said vertically extending slot in said support when said first member reaches an uppermost position.

* * * * *